US007190359B2

(12) United States Patent
Yoneyama

(10) Patent No.: US 7,190,359 B2
(45) Date of Patent: Mar. 13, 2007

(54) DISPLAY DRIVER, ELECTRO-OPTICAL DEVICE, AND DISPLAY DRIVING METHOD

(75) Inventor: Tsuyoshi Yoneyama, Fujimi-machi (JP)

(73) Assignee: Seiko Epson Corporation (JP)

( * ) Notice: Subject to any disclaimer, the term of this patent is extended or adjusted under 35 U.S.C. 154(b) by 561 days.

(21) Appl. No.: 10/787,831

(22) Filed: Feb. 26, 2004

(65) Prior Publication Data

US 2004/0212750 A1 Oct. 28, 2004

(30) Foreign Application Priority Data

Feb. 26, 2003 (JP) ..... 2003-049026

(51) Int. Cl.
*G09G 5/00* (2006.01)

(52) U.S. Cl. ..... 345/204; 345/100

(58) Field of Classification Search ..... 345/204, 345/98, 99, 100, 87; 315/169.1; 257/72
See application file for complete search history.

(56) References Cited

U.S. PATENT DOCUMENTS 6,275,209 B1 8/2001 Yamamoto

FOREIGN PATENT DOCUMENTS

JP 07-098577 A 4/1995
JP 10-301081 11/1998
JP 2002-351417 * 12/2002

OTHER PUBLICATIONS

Communication from Japanese Patent Office regarding corresponding application.

* cited by examiner

*Primary Examiner*—Richard Hjerpe
*Assistant Examiner*—Abbas Abdulselam
(74) *Attorney, Agent, or Firm*—Harness, Dickey & Pierce, P.L.C.

(57) ABSTRACT

A display driver, an electro-optical device, and a display driving method are provided that can regulate output voltages with high precision and without reducing reliability. The display driver includes an electronic volume value generating circuit that generates an electronic volume value for regulating output voltages, a power supply circuit that generates output voltages using a standard voltage amended based on the electronic volume value, a driving circuit that drives the electro-optical element based on the output voltages corresponding to display data, and an absolute value setting register for setting an electronic volume absolute value. The driving circuit uses an amendment value corresponding to a difference between a given characteristic value set in accordance with the electro-optical element being driven and a center value of a range that can be taken by the electronic volume value to amend the electronic volume absolute value, thereby generating the electronic volume value.

9 Claims, 6 Drawing Sheets

DISPLAY DRIVER, ELECTRO-OPTICAL DEVICE, AND DISPLAY DRIVING METHOD

RELATED APPLICATIONS

The present application claims priority to Japanese Patent Application No. 2003-049026 filed Feb. 26, 2003 which is hereby expressly incorporated by reference herein in its entirety.

BACKGROUND

1. Field of the Invention

The present invention relates to a display driver, an electro-optical device, and a display driving method.

2. Description of the Related Art

When a voltage is applied to liquid crystals, which is one example of an electro-optical element, the transmissivity of the liquid crystals changes in accordance with transmission characteristics of the liquid crystals. Accordingly, a display driver that drives an electro-optical device including liquid crystals changes the voltage applied to liquid crystals in accordance with the transmission characteristics of the liquid crystals to realize a multi-tone representation.

The applied voltage of the liquid crystals changes depending on production tolerance and a mounting state. The transmission characteristics of the liquid crystals also depend on the liquid crystal material. This means that display drivers are designed so as to be able to regulate the output voltage that depends on production tolerance, the type of liquid crystal material, and the like. In a display driver, an electronic volume control that can variably control the output voltage is used, for example. In this case, according to command settings from a host, such as an MPU (Micro Processor Unit), an electronic volume value that is a parameter for regulating the electronic volume control is changed. The display driver generates an output voltage corresponding to the changed electronic volume value. The electro-optical device is driven by this output voltage.

However, in a conventional display driver, the electronic volume value is incremented according to command settings. A user finds an optimal electronic volume value by carrying out a relative evaluation in which an image displayed by a device is viewed and evaluated every time. This means that it has been necessary for the user to perform command settings numerous times. Accordingly, it is preferable to be able to set the electronic volume value as an absolute value for regulating the electronic volume control of a display driver.

However when the electronic volume value is set using an absolute value, depending on the liquid crystal material being driven and production tolerance, the center value of a range that can be taken by the electronic volume value becomes shifted. This means that even if the electronic volume value is set using an absolute value, it is not possible to correctly regulate the output voltage as intended.

Also, in a conventional display driver, the range that can be taken by the electronic volume value is fixed. By setting a value near an upper limit (or lower limit) of the electronic volume value, an excessive voltage is applied, which can also cause a reduction in the reliability of the electronic volume control and the display driver (and the electro-optical device including this display driver).

The present invention was conceived in view of the above technical problem and it is an object of the present invention to provide a display driver, an electro-optical device, and a display driving method that can regulate an output voltage using an absolute value.

It is a further object of the present invention to provide a display driver, an electro-optical device, and a display driving method that can regulate an output voltage with high precision without reducing reliability.

SUMMARY

In order to address the problems, the present invention relates to a display driver that drives an electro-optical element, comprising: an electronic volume value generating circuit that generates an electronic volume value for regulating an output voltage; a power supply circuit that generates the output voltage using a standard voltage amended based on the electronic volume value; a driving circuit that drives the electro-optical element based on the output voltage corresponding to display data; and an absolute value setting register for setting an electronic volume absolute value, wherein the electronic volume value generating circuit generates the electronic volume value by amending the electronic volume absolute value using an amendment value corresponding to a difference between a given characteristic value set according to the electro-optical element being driven and a center value of a range that can be taken by the electronic volume value.

Here, the electronic volume absolute value can be said to be a value in the range that can be taken by the electronic volume value. This electronic volume value is set directly in the absolute value setting register.

In the present invention, an absolute value setting register, in which an absolute value of an electronic volume value for regulating an output voltage is set, is included in a display driver. The electronic volume value is generated by amending the electronic volume absolute value set in the absolute value setting register using an amendment value corresponding to a difference between a given characteristic value set according to the electro-optical element being driven and a center value of the electronic volume value. By doing so, it is possible to regulate the output voltage based on the electronic volume absolute value set in the absolute value setting register, so that the regulation process for the output voltage can be simplified. By setting an electronic volume absolute value that is successively incremented in the absolute value setting register, it is possible to evaluate the image every time the electronic volume value is incremented. In addition, since the output voltage is regulated using the electronic volume value amended by the amendment value, it is possible to regulate the output voltage correctly without depending on the electro-optical element being driven, production tolerance, and the like.

In the display driver according to the present invention, it is possible to include an upper limit setting register for setting an upper limit of the electronic volume value corresponding to an upper limit of the output voltage and a lower limit setting register for setting a lower limit of the electronic volume value corresponding to a lower limit of the output voltage, with the electronic volume value generating circuit generating the electronic volume value between the upper limit and the lower limit.

According to the present invention, by setting the electronic volume absolute value, it is possible to avoid reductions in reliability caused by an unintended voltage being applied.

The display driver according to the present invention can also include a center value setting register that is rewritable and in which the center value is set, with the electronic volume value generating circuit generating the electronic volume value using the center value set in the center value setting register.

According to the present invention, regardless of the number of bits used to express the electronic volume value, it is possible to regulate the output voltage using a number of bits that the user considers appropriate.

The display driver according to the present invention can also include a characteristic value setting register that is rewritable and in which the characteristic value is set, with the electronic volume value generating circuit generating the electronic volume value using the characteristic value set in the characteristic value setting register.

According to the present invention, it is possible to provide a display driver that can regulate an output voltage that is appropriate for the electro-optical element being driven.

In the display driver according to the present invention, the electronic volume value generating circuit can include: an amendment value generating unit that generates the amendment value by subtracting the characteristic value from the center value and also generates a flag corresponding to a subtraction result thereof; first and second full adder units that add the amendment value and the electronic volume absolute value; a first selection outputting unit that compares an addition result of the first full adder unit with the upper limit and selectively outputs a larger value thereof; a second selection outputting unit that compares an addition result of the second full adder unit with the lower limit and selectively outputs a smaller value thereof; and a third selection outputting unit that selects an output of one of the first and the second selection outputting units based on the flag and outputs the selected output as the electronic volume value.

In the display driver according to the present invention, it is possible for the first full adder unit to add the amendment value and the electronic volume absolute value and also generate a first carry flag corresponding to an addition result thereof, and to output an addition result, which is masked based on the first carry flag, to the first selection outputting unit, and for the second full adder unit to add the amendment value and the electronic volume absolute value and also generate a second carry flag corresponding to an addition result thereof, and to output an addition result, which is masked based on the second carry flag, to the second selection outputting unit.

According to the present invention, it is possible to simplify the regulation process using a simple construction and to generate an electronic volume value for regulating the output voltage at high precision.

The present invention also relates to an electro-optical device comprising any of the display drivers described above and a panel with an electro-optical element driven by the display driver.

The present invention also relates to an electro-optical device comprising any of the display drivers described above and an electro-optical element driven by the display driver.

According to the present invention, it is possible to provide an electro-optical device whose output voltage is optimized without depending on the electro-optical element.

The present invention also relates to a display driving method for driving an electro-optical element using an output voltage generated based on a standard voltage, comprising steps of: preparing an electronic volume absolute value that is an absolute value of an electronic volume value; generating the electronic volume value by amending the electronic volume absolute value using an amendment value corresponding to a difference between a given characteristic value set according to the electro-optical element being driven and a center value of a range that can be taken by the electronic volume value for regulating the output voltage; generating a standard voltage amended based on the electronic volume value; generating the output voltage based on the standard voltage; and driving the electro-optical element based on the output voltage corresponding to the display data.

DETAILED DESCRIPTION

The present invention will now be described in detail with reference to the drawings showing preferred embodiments thereof. It should be noted that the embodiments described below do not limit the scope of the invention as defined in the range of the patent claims. Further, no part of the constructions described below represents an essential structural element for the present invention.

1. Electro-Optical Device

The following-describes an embodiment in which the present invention has been applied to a liquid crystal device that is one example of an electro-optical device.

Figure 1:
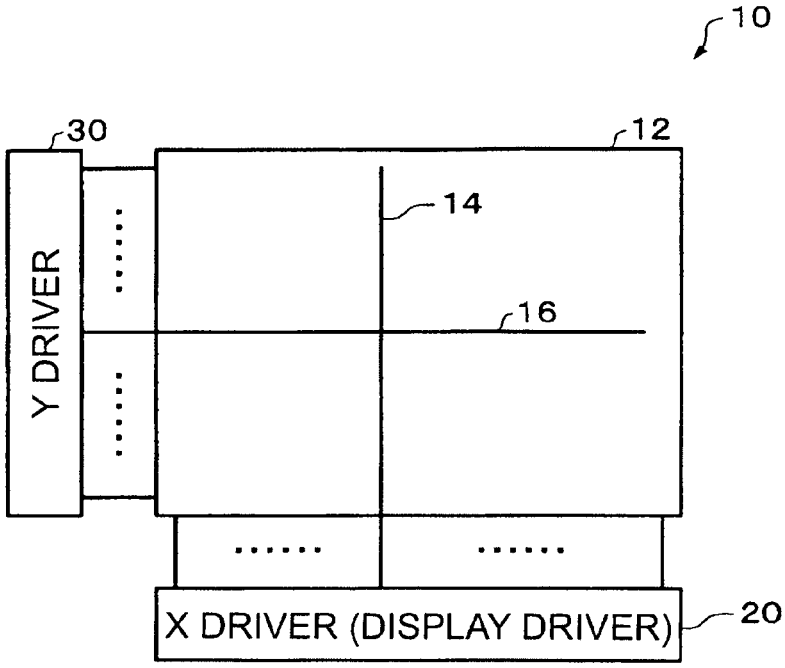
FIG. 1 is a schematic diagram useful in explaining a liquid crystal device according to a present embodiment.

FIG. 1 is a schematic diagram useful in explaining a liquid crystal device. A liquid crystal device 10 in FIG. 1 includes a simple matrix-type liquid crystal panel 12. The liquid crystal panel 12 is formed by having liquid crystals sealed between a first substrate (not shown) on which segment electrodes (first electrodes) 14 are formed and a second substrate (not shown) on which common electrodes (second electrodes) 16 are formed.

The liquid crystal device 10 includes an X driver (display driver) 20 and a Y driver 30. The X driver 20 supplies an output voltage or voltages corresponding to display data to the segment electrodes 14 formed in the liquid crystal panel 12. The Y driver 30 selects a common electrode 16 formed on the liquid crystal panel 12 and drives the selected common electrode.

The liquid crystal device 10 is controlled by an MPU, not shown. The MPU supplies command data, display data, address data, and the like to the X driver 20. The MPU also performs display control by indicating display timing to the X driver 20 or to the X driver 20 and the Y driver 30.

The X driver 20 and the Y driver 30 drive the liquid crystal panel 12 according to a method such as MLS (Multi-Line Selection). More specifically, the X driver 20 simultaneously selects four segment electrodes 14 during one horizontal scanning period and supplies the output voltages, and the Y driver 30 selects the same common electrode 16 a plurality of times during one vertical scanning period.

It should be noted that the liquid crystal device 10 to which the present invention is applied is not necessarily limited to including a simple matrix-type liquid crystal panel 12 driven according to MLS. For example, the present invention can be applied to a device including a display driven according to a line progressive scanning method, or to a device including an active matrix-type liquid crystal panel using two-terminal elements, such as MIS (Metal Insulator Semiconductors), MIM (Metal Insulator Metal), and the like, or three-terminal elements, such as thin film transistors (TFT).

2. Display Driver

Figure 2:
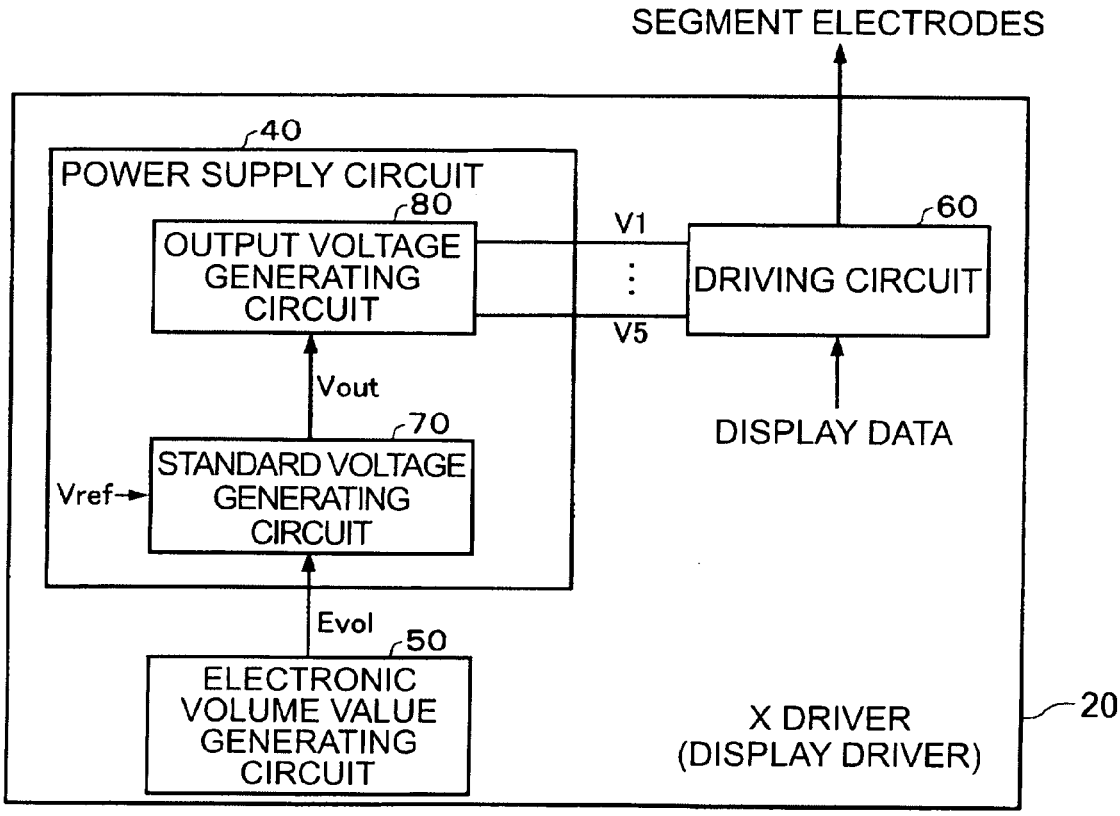
FIG. 2 is a block diagram showing a main part of a construction of an X driver according to the present embodiment.

FIG. 2 is a block diagram showing a main part of the X driver 20. The X driver 20 includes a power supply circuit 40, an electronic volume value generating circuit 50, and a driving circuit 60.

The driving circuit 60 drives the segment electrodes using output voltages (for example, V1 to V5) generated by the power supply circuit 40. More specifically, the driving circuit 60 drives the segment electrodes using output voltages corresponding to display data. This driving circuit 60 is realized by an operational amplifier, for example.

The power supply circuit 40 generates an output voltage using a standard voltage that has been amended based on an electronic volume value Evol generated by the electronic volume value generating circuit 50. More specifically, the power supply circuit 40 generates a standard voltage by amending a reference voltage based on the electronic volume value Evol, and generates one or a plurality of output voltages based on this standard voltage. To do so, the power supply circuit 40 includes a standard voltage generating circuit 70 and an output voltage generating circuit 80.

The standard voltage generating circuit 70 includes an electronic volume control, and generates a standard voltage Vout by amending a reference voltage Vref based on the electronic volume value Evol. The output voltage generating circuit 80 generates one or a plurality of output voltages V1 to V5 by performing at least one of boosting, lowering, regulating, and dividing the standard voltage Vout.

Figure 3:
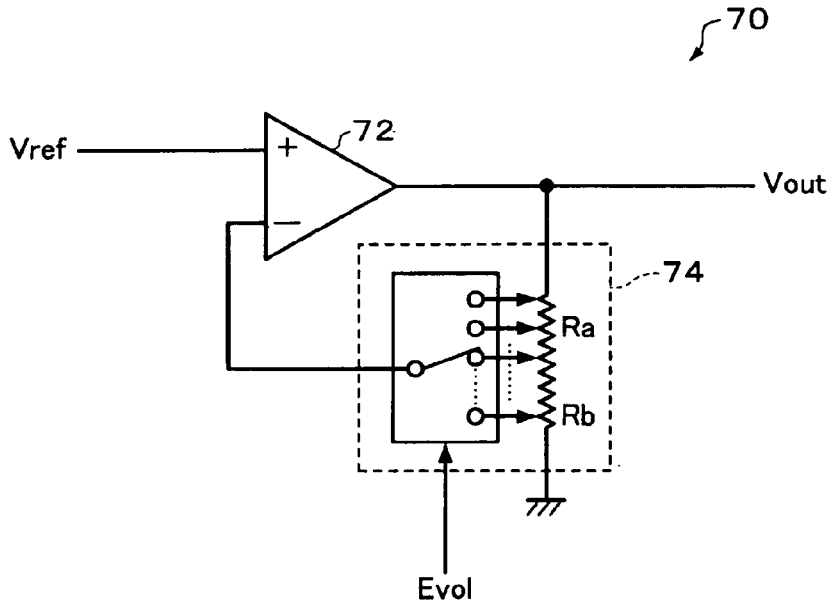
FIG. 3 is a circuit block diagram showing an example construction of a standard voltage generating circuit shown in FIG. 2.

FIG. 3 shows an example construction of the standard voltage generating circuit 70 shown in FIG. 2. The standard voltage generating circuit 70 includes an operational amplifier 72 and an electronic volume control 74. The output voltage of the operational amplifier 72 is the standard voltage Vout. The reference voltage Vref is inputted into a non-inverting input terminal of the operational amplifier 72. A voltage outputted from the electronic volume control 74 is inputted into an inverting input terminal of the operational amplifier 72.

The electronic volume control 74 includes a variable resistor and a switch. The switch is electrically connected to one of a plurality of taps of the variable resistor and to the inverting input terminal of the operational amplifier 72, based on the electronic volume value Evol. When a total resistance of the variable resistor is (Ra+Rb), resistance values (Ra and Rb) (or a resistance ratio thereof) of two resistors that are divided by the switch change based on the electronic volume value Evol.

The standard voltage Vout is expressed by the following equation.

$$Vout = Vref \cdot (Ra+Rb)/Ra \quad (1)$$

Accordingly, it is possible to regulate the standard voltage Vout in accordance with the electronic volume value Evol.

Figure 4:
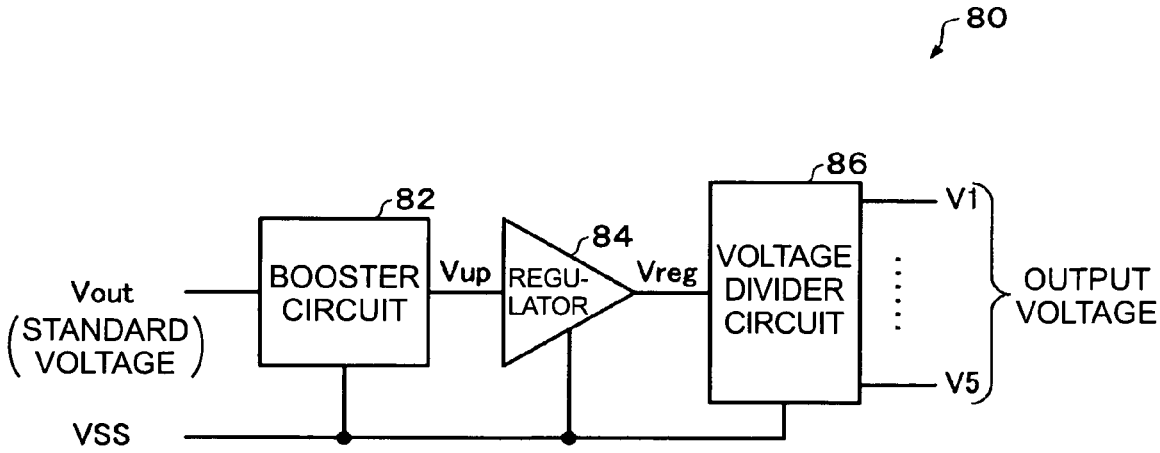
FIG. 4 is a block diagram showing an example construction of an output voltage generating circuit shown in FIG. 2.

FIG. 4 shows an example construction of the output voltage generating circuit 80 shown in FIG. 2. The output voltage generating circuit 80 can include a booster circuit 82, a regulator 84, and a voltage divider circuit 86.

The booster circuit 82 generates a boosted voltage Vup by boosting a voltage between a standard voltage Vout generated by the standard voltage generating circuit 70 and a system ground power supply voltage VSS by a predetermined factor. This booster circuit 82 is realized by a charge pump circuit. The charge pump circuit generates a boosted voltage Vup, produced by boosting a voltage between the standard voltage Vout and the system ground power supply voltage VSS by a predetermined factor, based on a boosting clock.

The regulator 84 generates a regulation voltage Vreg produced by regulating the boosted voltage Vup. This regulator 84 is realized by an operational amplifier connected to a voltage follower, for example.

The voltage divider circuit 86 generates the output voltages V1 to V5 by dividing a voltage between the regulation voltage Vreg and the system ground power supply voltage VSS. This voltage divider circuit 86 is realized by a ladder resistor, for example.

In FIG. 2, the electronic volume value generating circuit 50 generates the electronic volume value Evol corresponding to an absolute value of the electronic volume value set by the MPU. More specifically, in the electronic volume value generating circuit 50, an amendment value is generated corresponding to a difference between a given liquid crystal characteristic value (in a broadest sense, a "characteristic value") set according to the liquid crystals being driven and a center value of a range that the electronic volume value can take. After this, the electronic volume value Evol is generated by amending the electronic volume absolute value using the above amendment value. Here, the electronic volume absolute value is a value set by the user, for example, as a value within a range that the electronic volume value can take.

Figure 5:
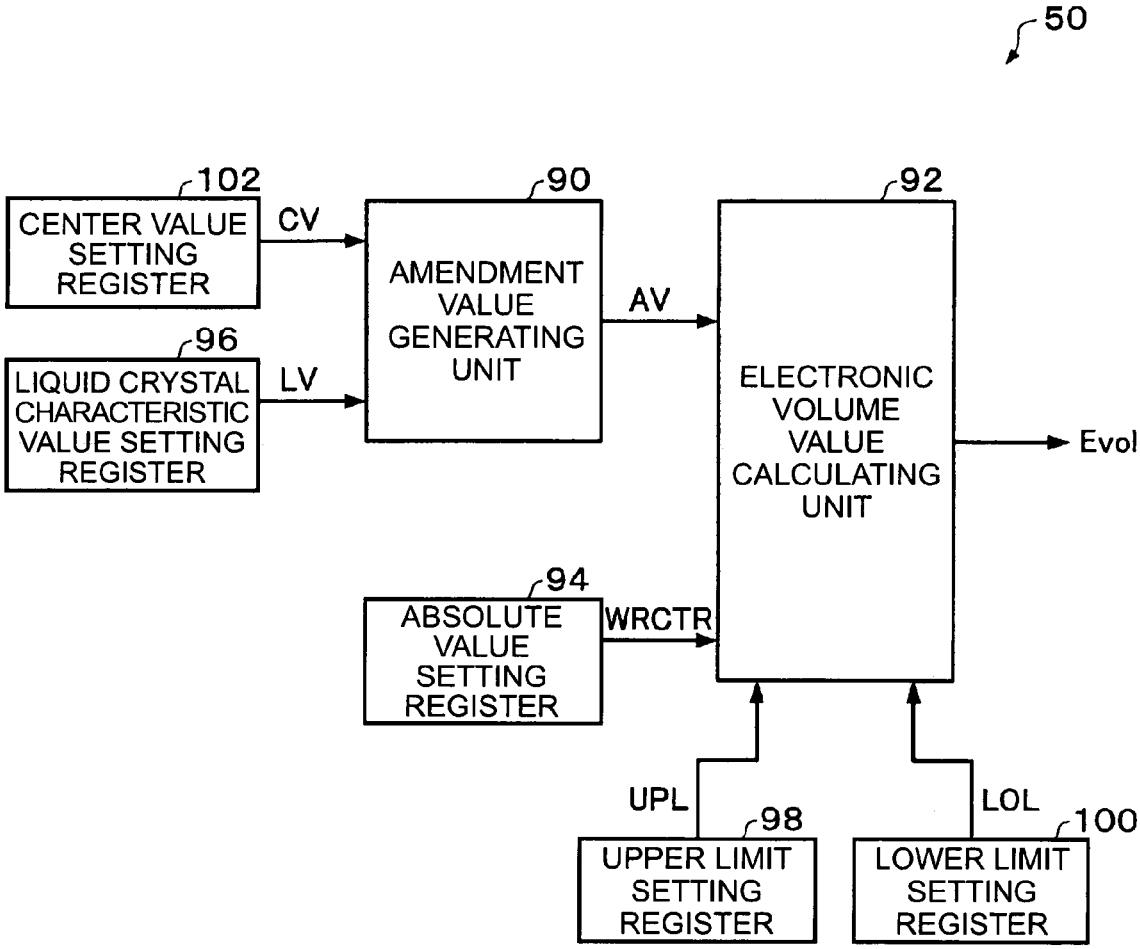
FIG. 5 is a block diagram schematically showing the construction of an electronic volume value generating circuit according to the present embodiment.

FIG. 5 schematically shows the construction of the electronic volume value generating circuit 50 shown in FIG. 2. The electronic volume value generating circuit 50 includes an amendment value generating unit 90 and an electronic volume value calculating unit 92.

The amendment value generating unit 90 generates an amendment value AV corresponding to a difference between the given liquid crystal characteristic value LV set according to the liquid crystals being driven and a center value CV of the range that can be taken by the electronic volume value. More specifically, the amendment value generating unit 90 generates the amendment value AV according to the following equation.

$$AV = LV - CV \quad (2)$$

Here, the liquid crystal characteristic value LV is a characteristic value set in accordance with a type of liquid crystal material being driven. More specifically, the liquid crystal characteristic value LV can be said to be a center value of a range calculated corresponding to characteristics (for example, transmission characteristics) of the liquid crystals being driven, out of values in a range that can be taken by the electronic volume value. Further, the center value CV can be said to be a center value of a range of values that can be taken by the electronic volume value that can be set by the user.

The amendment value generating unit 90 generates a difference between a center value of the electronic volume value determined in accordance with characteristics of the liquid crystals being driven and a center value of the electronic volume value that can be set by the user as the amendment value AV.

The electronic volume value calculating unit 92 generates the electronic volume value Evol by amending the electronic volume absolute value WRCTR, which is a value in a range that can be taken by the electronic volume value, using the amendment value AV. More specifically the electronic volume value calculating unit 92 generates the electronic volume value Evol according to the following equation.

$$Evol=AV+WRCTR \quad (3)$$

To do so, the electronic volume value generating circuit 50 includes an absolute value setting register 94. A setting content of the absolute value setting register 94 can be rewritten by a command setting from the MPU.

In the electronic volume value generating circuit 50, the electronic volume value Evol can be generated from the following equation found from Equations (2) and (3).

$$Evol=(LV-CV)+WRCTR \quad (4)$$

The electronic volume value generating circuit 50 can also include a liquid crystal characteristic value setting register 96. A setting content of the liquid crystal characteristic value setting register 96 can be rewritten according to a command setting from the MPU. By doing so, it is possible to generate an electronic volume value that can regulate the output voltages at high precision in accordance with the characteristics of the liquid crystals being driven.

The X driver 20 can regulate the output voltages based on the electronic volume value Evol calculated based on Equation (4). By doing so, the output voltages can be regulated using the electronic volume absolute value WRCTR, so that the regulating process can be simplified. Also, by setting a successively incremented electronic volume absolute value WRCTR in the absolute value setting register 94, it is possible to evaluate an image every time the electronic volume value is incremented.

The output voltages are regulated using the electronic volume value Evol produced by amending the electronic volume absolute value WRCTR, using a difference between the liquid crystal characteristic value set in accordance with the characteristics of liquid crystals being driven and the center value of the electronic volume value that can be set by the user as the amendment value AV. By doing so, it becomes possible to correctly regulate the output voltages without depending on the liquid crystals being driven, production tolerance, and the like.

The electronic volume value calculating unit 92 should preferably generate the electronic volume value Evol amended using the amendment value AV in a range between an upper limit UPL of the electronic volume value and a lower limit LOL of the electronic volume value.

In this case, the electronic volume value generating circuit 50 is constructed so as to include an upper limit setting register 98 and a lower limit setting register 100. The upper limit UPL of the electronic volume value is set in the upper limit setting register 98 according to a command setting from the MPU. The lower limit LOL of the electronic volume value is set in the lower limit setting register 100 according to a command setting from the MPU.

By doing so, it is possible to prevent reliability from being reduced due to an excessive application of voltage to the power supply circuit 40, the X driver 20, and the liquid crystal device 10 that includes the X driver 20.

The electronic volume value generating circuit 50 should preferably also include a center value setting register 102 for setting the center value CV. The center value set in the center value setting register 102 can be changed according to a command setting from the MPU. By doing so, even if the number of bits used by the user to express the electronic volume value changes, the output voltages can be regulated without placing a burden upon the user. As one example, regardless of a case where "63" is set as the center value CV of a range from "0" to "127" that can be taken by an electronic volume value expressed using seven bits, it is possible to set "31" as the center value CV of a range from "0" to "63" that can be taken by an electronic volume value expressed using six bits.

Also, it is possible to provide an X driver 20 which, according to the values respectively set in the upper limit setting register 98, the lower limit setting register 100, and the center value setting register 102, can regulate the output voltages in an arbitrary range within the range of values that can be taken by the electronic volume value. For example, even when the range of values that can be taken by a seven-bit electronic volume value is "0" to "127", the center value CV can be set at "50", the upper limit UPL can be set at "60", and the lower limit LOL can be set at "40", so that the output voltages can be regulated in a range where the electronic volume value is "40" to "60".

It should be noted that in FIG. 5, at least one of the absolute value setting register 94, the liquid crystal characteristic value setting register 96, the upper limit setting register 98, the lower limit setting register 100, and the center value setting register 102 may be provided outside the electronic volume value generating circuit 50.

Figure 6:
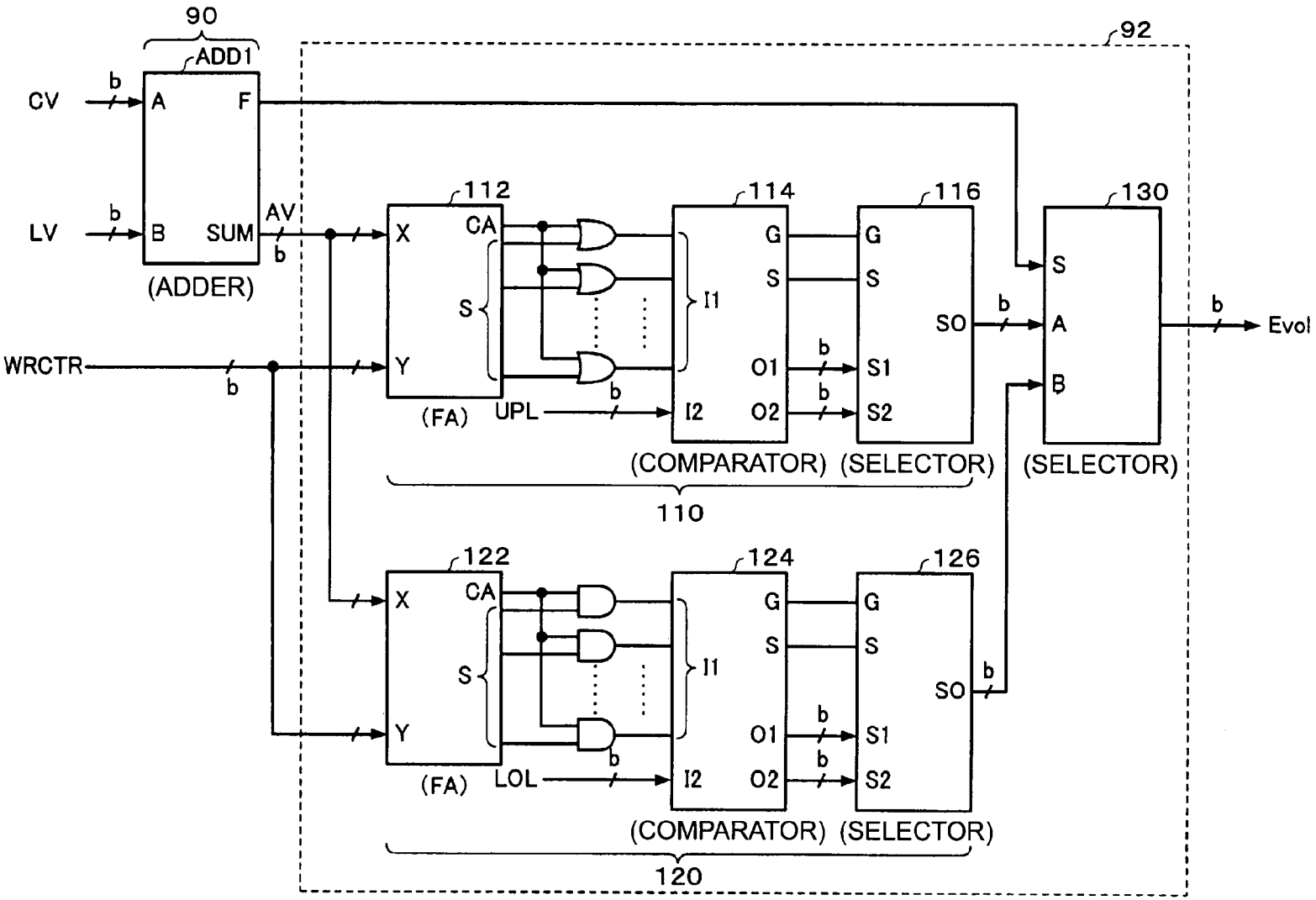
FIG. 6 is a circuit block diagram showing an example construction of an electronic volume value generating circuit according to the present embodiment.

In FIG. 6, an example construction of the electronic volume value generating circuit 50 is shown. Here, an example circuit construction for the case where the amendment value generating unit 90 and the electronic volume value calculating unit 92 are realized by hardware is shown.

The amendment value generating unit 90 is realized by an adder ADD1. The adder ADD1 subtracts the center value CV from the liquid crystal characteristic value LV and outputs this subtraction result (the amendment value AV), and also generates a flag corresponding to the subtraction result. Also, it can be said that the adder ADD1 adds a two's complement of the center value CV and the liquid crystal characteristic value LV and generates a flag corresponding to this addition result.

In the adder ADD1, when the liquid crystal characteristic value LV is equal to or higher than the center value CV, a value produced by subtracting the center value CV from the liquid crystal characteristic value LV is outputted from an output terminal SUM and a flag outputted from a flag terminal F is set at an "H" level.

Also, when the liquid crystal characteristic value LV is lower than the center value CV, a value produced by subtracting the center value CV from the liquid crystal characteristic value LV is outputted from the output terminal SUM and the flag outputted from the flag terminal F is set at an "L" level. At this point, the outputted subtraction value is a negative number, so that a two's complement is actually outputted.

The electronic volume value calculating unit 92 includes a positive-side electronic volume value generating unit 110 for generating the electronic volume value when the flag is at the "H" level, a negative-side electronic volume value generating unit 120 for generating the electronic volume value when the flag is at the "L" level, and a selector (third selection outputting unit) 130.

The positive-side electronic volume value generating unit 110 includes a full adder (a first full adder) 112, a comparator 114, and a selector 116. The comparator 114 and the selector 116 compose a first selection outputting unit.

The negative-side electronic volume value generating unit 120 includes a full adder (a second full adder) 122, a comparator 124, and a selector 126. The comparator 124 and the selector 126 compose a second selection outputting unit.

In the positive-side electronic volume value generating unit 110, first the full adder 112 adds the amendment value AV inputted via an X terminal and the electronic volume absolute value WRCTR inputted via a Y terminal. An addition result (X+Y=AV+WRCTR) is outputted from an S terminal. When a carry is generated, a carry flag CA is set at "1", and a CA terminal is set at an "H" level.

In FIG. 6, an addition result outputted from the full adder 112 is masked by the carry flag CA. That is, when a result of adding the amendment value AV and the electronic volume absolute value WRCTR, which are both seven-bit values, exceeds a highest value "127" that can be expressed using seven bits, the carry flag CA is set at "1" and input data inputted into an I1 terminal of the comparator 114 becomes "127". On the other hand, when a result of adding the amendment value AV and the electronic volume absolute value WRCTR, which are both seven-bit values, does not exceed the highest value "127" that can be expressed using seven bits, the carry flag CA remains at "0" so that an addition result of the full adder 112 is inputted into the I1 terminal of the comparator 114 as it is.

The comparator 114 compares the input data inputted via the I1 terminal and the upper limit UPL inputted via an I2 input terminal, and generates a G flag and an S flag. It should be noted that the input data inputted via the I1 terminal is outputted as it is from an O1 terminal and the upper limit UPL is outputted as it is from an O2 terminal.

When the input data inputted into the I1 terminal is equal to or greater than the upper limit UPL inputted into the I2 terminal, the G flag is set at "1" and a G flag signal outputted from the G terminal is set at "H". The S flag is set at "0" and an "S" flag signal outputted from the S terminal is set at the "L" level.

When input data inputted into the I1 terminal is lower than the upper limit UPL inputted into the I2 terminal, the G flag is set at "0" and the G flag signal is set at an "L" level. Also, the S flag is set at "1" and the S flag signal is set at an "H" level.

When the G flag signal is at the "H" level, the selector 116 outputs the upper limit UPL inputted via an S2 terminal. When the S flag signal is at the "H" level, the selector 116 outputs the input data inputted via the I1 terminal of the comparator 114 that is inputted via an S1 terminal.

That is, the first selection outputting unit compares the addition result of the full adder 112 (an addition result of the first full adder) with an upper limit UPL and selectively outputs the larger value. It should be noted that the addition result of the full adder 112 may not need to be masked by the carry flag CA of the full adder 112.

In the negative-side electronic volume value generating unit 120, first the full adder 122 adds the amendment value AV inputted via an X terminal and the electronic volume absolute value WRCTR inputted via a Y terminal. An addition result (X+Y=AV+WRCTR) is outputted from an S terminal. When a carry is generated, a carry flag CA is set at "1", and a CA terminal is set at an "H" level.

An addition result outputted from the full adder 122 is masked by the carry flag CA. In this case, unlike the full adder 112, an addition of two's complements is performed by the full adder 122. Accordingly, when a result of adding the amendment value AV and the electronic volume absolute value WRCTR, which are both seven-bit values, is below "0" that can be expressed using seven bits, the carry flag CA is set at "0" and input data inputted into an I1 terminal of the comparator 114 is set at "0". On the other hand, when a result of adding the amendment value AV and the electronic volume absolute value WRCTR, which are both seven-bit values, is not below "0" that can be expressed using seven bits, the carry flag CA remains at "1" so that an addition result of the full adder 122 is inputted into the I1 terminal of the comparator 114 as it is.

The comparator 124 compares the input data inputted via the I1 terminal and the lower limit LOL inputted via an I2 input terminal, and generates a G flag and an S flag. It should be noted that the input data inputted via the I1 terminal is outputted as it is from an O1 terminal and the lower limit LOL is outputted as it is from an O2 terminal.

When the input data inputted into the I1 terminal is equal to or greater than the lower limit LOL inputted into the I2 terminal, the G flag is set at "1" and a G flag signal outputted from the G terminal is set at "H". The S flag is set at "0" and an "S" flag signal outputted from the S terminal is set at the "L" level.

When input data inputted into the I1 terminal is lower than the lower limit LOL inputted into the I2 terminal, the G flag is set at "0" and a G flag signal is set at an "L" level. Also, the S flag is set at "1" and an S flag signal is set at an "H" level.

When the G flag signal is at the "H" level, the selector 126 outputs the input data inputted via the I1 terminal of the comparator 124, and when the S flag signal is at the "H" level, the selector 116 outputs the lower limit LOL.

That is, the second selection outputting unit compares the addition result of the full adder 122 (an addition result of the second full adder) with the lower limit LOL and selectively outputs the smaller value.

A flag terminal F of the adder ADD1 is connected to an S terminal of the selector 130. When the flag inputted into the S terminal is at the "H" level, the selector 130 outputs output data from the selector 116 as the electronic volume value Evol. When the flag inputted into the S terminal is at the "L" level, the selector 130 outputs output data from the selector 126 as the electronic volume value Evol.

It should be noted that in FIG. 6, the amendment value generating unit 90 and the electronic volume value calculating unit 92 are described as being realized by hardware, but this is not a limitation. The amendment value generating unit 90 and the electronic volume value calculating unit 92 may be realized by software processing where a program stored in a memory is read out and executed by an MPU (CPU), or may be realized by firmware processing.

Figure 7B:
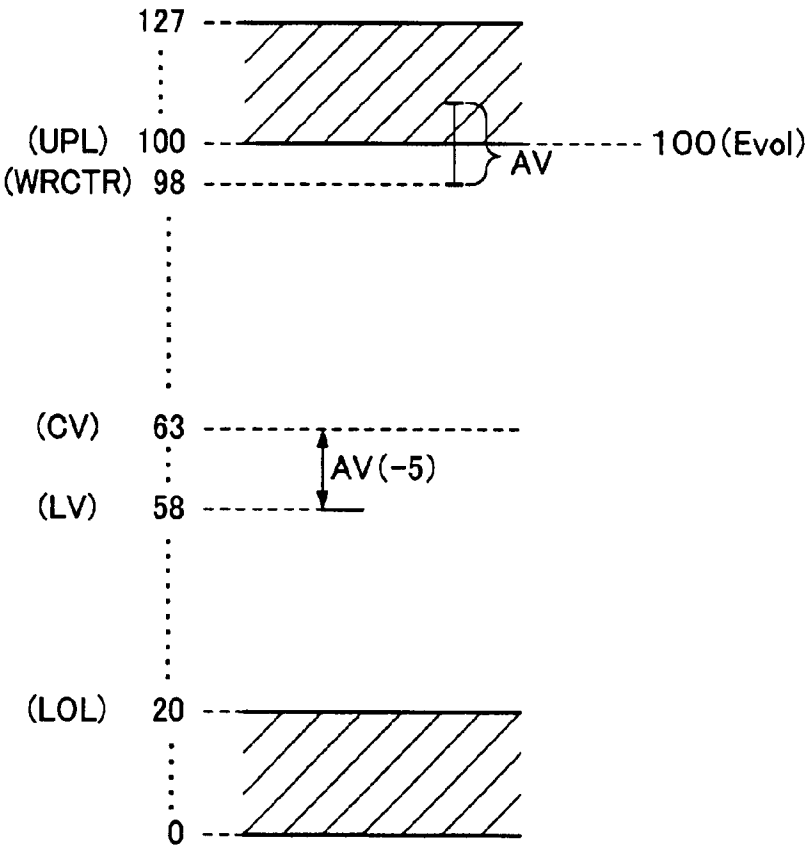
FIGS. 7(A) and (B) are operation diagrams useful in explaining the electronic volume value generating circuit according to the present embodiment.
Figure 7A:
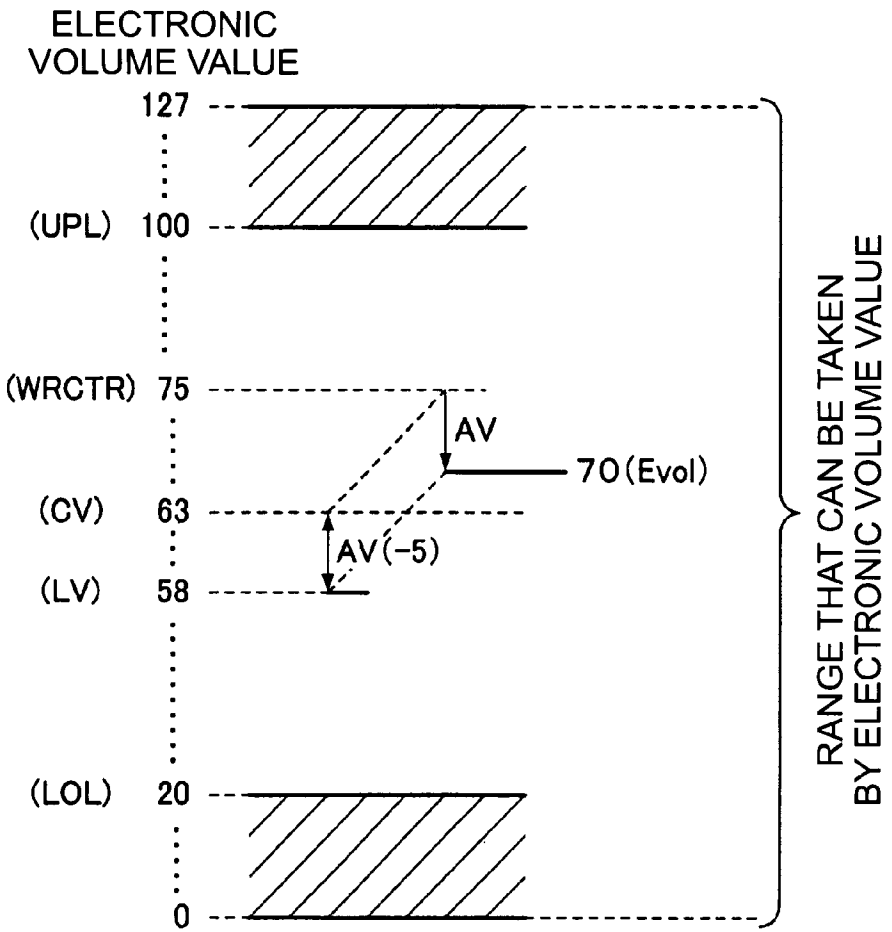

FIGS. 7(A) and 7(B) are diagrams useful in explaining the operation of the electronic volume value generating circuit 50 shown in FIG. 6. Here, the electronic volume value is expressed using seven bits and the range of values that can be taken by the electronic volume value is "0" to "127". Also, the center value CV set in the center value setting register 102 is "63", the liquid crystal characteristic value LV set in the liquid crystal characteristic value setting register 96 is "58", the upper limit UPL set in the upper limit setting register 98 is "100", and the lower limit LOL set in the lower limit setting register 100 is "20".

In FIG. 7(A), a case where the electronic volume absolute value WRCTR set in the absolute value setting register 94 is "75" is shown. In this case, the amendment value AV is set at "−5" by the amendment value generating unit 90. Accordingly, if the electronic volume absolute value WRCTR is set at "75", the electronic volume value Evol is set at "70" by the electronic volume value calculating unit 92.

That is, when the user has recognized that the center value CV of the electronic volume value is "63", the electronic volume absolute value WRCTR is set at "75" in order to raise the electronic volume value by "12" with the center value CV as a standard. However, when the center value of the electronic volume that is originally determined by characteristics of the liquid crystals being driven due to production tolerance and the like is "58", if the electronic volume value Evol is left as it is at "75", it will not be possible to generate output voltages for obtaining an image visualized by the user. However, since the output voltages are regulated by the electronic volume value calculating unit 92 using "70" as the electronic volume value Evol, it is possible to obtain an image where the electronic volume value has been increased by "12" (=70−58) as intended by the user.

FIG. 7(B) shows a case where the electronic volume absolute value WRCTR set in the absolute value setting register 94 is "98". When the electronic volume absolute value WRCTR is set at "98", the electronic volume value Evol is set at "100" which is the upper limit UPL of the electronic volume value.

That is, when the user recognizes the center value CV of the electronic volume value as "63", the electronic volume absolute value WRCTR is set at "98" so as to raise the electronic volume value by "35" based on the center value CV. However, when the electronic volume value Evol is "103", an excessive voltage would be applied to the X driver 20 and the liquid crystal device 10 that includes the X driver 20, resulting in reduced reliability, but since output voltages corresponding to an electronic volume value Evol at the upper limit UPL of "100" are outputted, it is possible to reduce such excessive applied voltages and so prevent a reduction in reliability.

3. Other Considerations

It should be noted that although the X driver 20 of the present embodiment has been described as been applied to the liquid crystal device 10 shown in FIG. 1, the X driver 20 is not limited to this.

Figure 8:
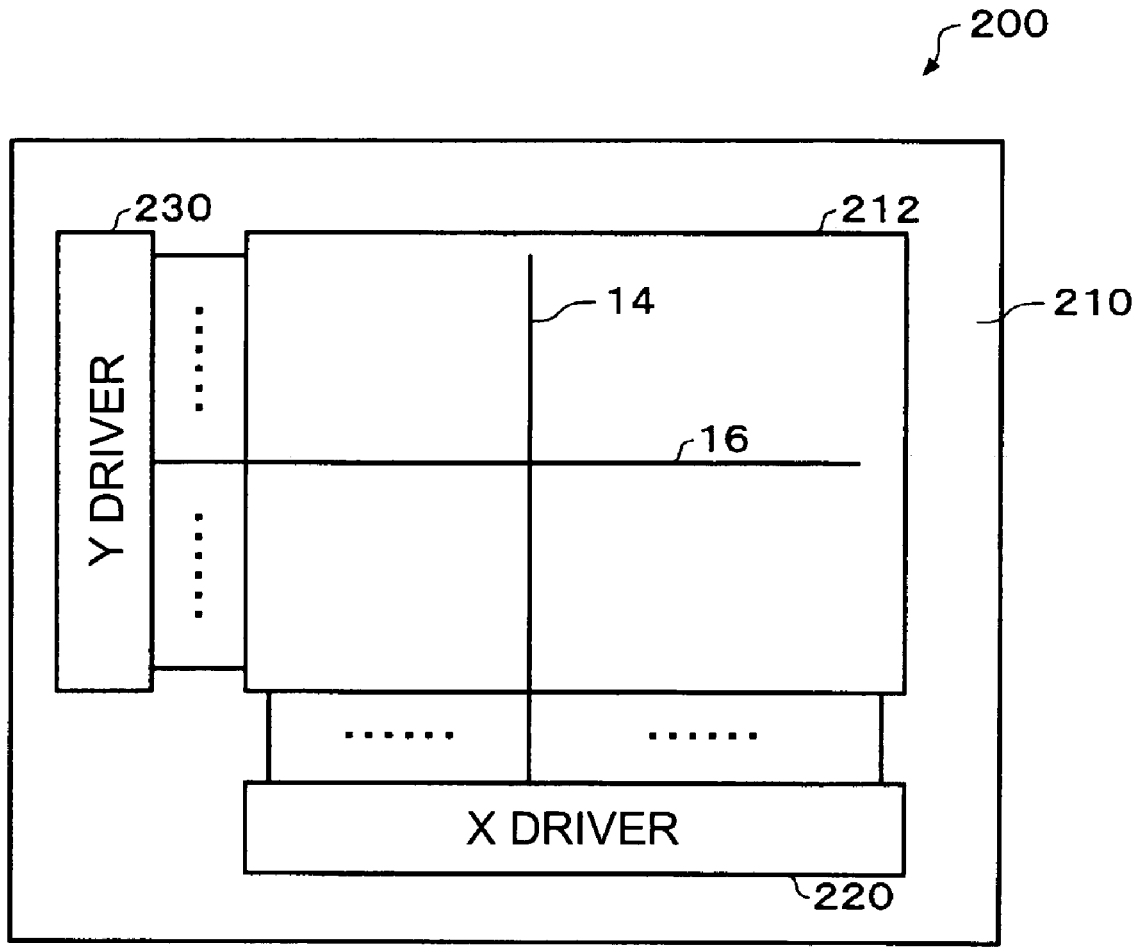
FIG. 8 is a schematic diagram useful in explaining another example construction of a liquid crystal device according to the present embodiment.

FIG. 8 is a schematic diagram useful in explaining another example construction of a liquid crystal device. A liquid crystal device 200 shown in FIG. 8 has an X driver 220 and a Y driver 230 formed on a first glass substrate 210. This liquid crystal device 200 is constructed, for example, by having liquid crystals sealed between the first glass substrate 210 on which common electrodes are formed and a second glass substrate 212 on which segment electrodes are formed.

Here, the X driver 220 has the functions of the X driver 20 shown in FIG. 1. The Y driver 230 has the functions of the Y driver 30 shown in FIG. 1.

The X driver according to the present embodiment can also be applied to a liquid crystal device with this kind of COG construction.

It should be noted that the present invention is not limited to the embodiment described above and a variety of modifications can be made within the scope of the present invention.

Also, while the case where the present invention is applied to an X driver has been described in the present embodiment, the present invention is not limited to this. The present invention can also be applied, at least, to a Y driver provided in a power supply circuit.

The liquid crystal device described above can be applied to an electronic appliance, such as a mobile telephone set, on which a display unit using an electro-optical element, such as a liquid crystal element, is mounted. Such a liquid crystal device can also be mounted on an electronic appliance such as a personal computer, mobile appliance, a camera with a viewfinder, a pager, a POS terminal, an electronic notebook, a navigation device, and the like.

Also, out of the present invention, inventions covered by the dependent claims can be constructed with some constructional aspects of the claims upon which such dependent claims depend omitted. The main part of the invention as described in any single independent claim may also be treated as being dependent upon any other independent claim.

What is claimed is:

1. A display driver that drives an electro-optical element, comprising:

an electronic volume value generating circuit that generates an electronic volume value for regulating an output voltage;

a power supply circuit that generates the output voltage using a standard voltage amended based on the electronic volume value;

a driving circuit that drives the electro-optical element based on the output voltage corresponding to display data; and an absolute value setting register for setting an electronic volume absolute value, wherein the electronic volume value generating circuit generates the electronic volume value by amending the electronic volume absolute value using an amendment value corresponding to a difference between a given characteristic value set according to the electro-optical element is being driven and a center value of a range that can be taken by the electronic volume value.

2. A display driver according to claim 1, further comprising:

an upper limit setting register for setting an upper limit of the electronic volume value corresponding to an upper limit of the output voltage; and a lower limit setting register for setting a lower limit of the electronic volume value corresponding to a lower limit of the output voltage, wherein the electronic volume value generating circuit generates the electronic volume value between the upper limit and the lower limit.

3. A display driver according to claim 1, further comprising a center value setting register that is rewritable and in which the center value is set, wherein the electronic volume value generating circuit generates the electronic volume value using the center value set in the center value setting register.

4. A display driver according to claim 1, further comprising a characteristic value setting register that is rewritable and in which the characteristic value is set, wherein the electronic volume value generating circuit generates the electronic volume value using the characteristic value set in the characteristic setting register.

5. A display driver according to claim 1, wherein the electronic volume value generating circuit comprises:

an amendment value generating unit that generates the amendment value by subtracting the center value from the characteristic value and also generates a flag corresponding to a subtraction result thereof;

first and second full adder units that add the amendment value and the electronic volume absolute value;

a first selection outputting unit that compares an addition result of the first full adder unit with the upper limit and selectively outputs a larger value thereof;

a second selection outputting unit that compares an addition result of the second full adder unit with the lower limit and selectively outputs a smaller value thereof; and a third selection outputting unit that selects an output of one of the first and the second selection outputting units based on the flag and outputs the selected output as the electronic volume value.

6. A display driver according to claim 5, wherein the first full adder unit adds the amendment value and the electronic volume absolute value and also generates a first carry flag corresponding to an addition result thereof, and outputs an addition result, which is masked based on the first carry flag, to the first selection outputting unit, and the second full adder unit adds the amendment value and the electronic volume absolute value and also generates a second carry flag corresponding to an addition result thereof, and outputs an addition result, which is masked based on the second carry flag, to the second selection outputting unit.

7. An electro-optical device comprising:

a display driver according to claim 1; and a panel with an electro-optical element driven by the display driver.

8. An electro-optical device comprising:

a display driver according to claim 1; and an electro-optical element driven by the display driver.

9. A display driving method for driving an electro-optical element using an output voltage generated based on a standard voltage, comprising the steps of:

preparing an electronic volume absolute value that is an absolute value of an electronic volume value;

generating the electronic volume value by amending the electronic volume absolute value using an amendment value corresponding to a difference between a given characteristic value set according to the electro-optical element is being driven and a center value of a range that can be taken by the electronic volume value for regulating the output voltage;

generating a standard voltage amended based on the electronic volume value;

generating the output voltage based on the standard voltage; and driving the electro-optical element based on the output voltage corresponding to the display data.

* * * * *